US006855852B1

(12) United States Patent
Jackson et al.

(10) Patent No.: US 6,855,852 B1
(45) Date of Patent: Feb. 15, 2005

(54) NATURAL GAS HYDRATE AND METHOD FOR PRODUCING SAME

(75) Inventors: Alan Jackson, Alfred Cove (AU); Robert Amin, Salter Point (AU)

(73) Assignee: Metasource Pty Ltd, Perth (AU)

( * ) Notice: Subject to any disclaimer, the term of this patent is extended or adjusted under 35 U.S.C. 154(b) by 0 days.

(21) Appl. No.: 10/019,474

(22) PCT Filed: Jun. 23, 2000

(86) PCT No.: PCT/AU00/00719

§ 371 (c)(1),
(2), (4) Date: Apr. 5, 2002

(87) PCT Pub. No.: WO01/00755

PCT Pub. Date: Jan. 4, 2001

(30) Foreign Application Priority Data

Jun. 24, 1999 (AU) ..... PQ1188

(51) Int. Cl.[7] ..... C07C 9/00; F25J 1/00
(52) U.S. Cl. ..... 585/15; 62/45.1
(58) Field of Search ..... 585/15; 62/45.1

(56) References Cited

U.S. PATENT DOCUMENTS

| | | | | |
|---|---|---|---|---|
| 2,270,016 A | * | 1/1942 | Benesh | 48/190 |
| 3,975,167 A | | 8/1976 | Nierman | |
| 5,536,893 A | | 7/1996 | Gudmundsson | |
| 5,778,685 A | | 7/1998 | Singh | |
| 5,806,316 A | | 9/1998 | Avakov et al. | |
| 6,082,118 A | | 7/2000 | Endrizzi et al. | |
| 6,389,820 B1 | * | 5/2002 | Rogers et al. | 62/45.1 |

FOREIGN PATENT DOCUMENTS

| | | |
|---|---|---|
| AU | 703736 | 12/1996 |
| GB | 2309227 A | 7/1997 |
| WO | WO 93/01153 | 1/1993 |
| WO | WO 98/27033 | 6/1998 |
| WO | WO 99/19662 | 4/1999 |

* cited by examiner

*Primary Examiner*—Walter D. Griffin
(74) *Attorney, Agent, or Firm*—Edell, Shapiro & Finnan, LLC

(57) ABSTRACT

A method for the production of the natural gas hydrate characterized by the steps of: combining natural gas and water to form a natural-gas water system and an agent adapted to reduce the natural gas-water interfacial tension to form a natural-gas water-agent system, allowing the natural gas-water-agent system to reach equilibrium at elevated pressure and ambient temperature and reducing the temperature of the natural gas-water-agent system to initiate the formation of the natural gas hydrate.

22 Claims, No Drawings

NATURAL GAS HYDRATE AND METHOD FOR PRODUCING SAME

FIELD OF THE INVENTION

The present invention relates to a natural gas hydrate. More particularly, the present invention relates to a natural gas hydrate with improved gas content and stability characteristics and a method for producing the same.

BACKGROUND ART

Natural gas hydrates are a stable solid comprising water and natural gas, and have been known to scientists for some years as a curiosity. More recently, natural gas hydrates became a serious concern in regard to the transportation and storage of natural gas industries in cold climates, due to the tendency of hydrates to form in pipelines thereby blocking the flow the pipelines.

Natural gas hydrates may be formed by the combination of water and gas at relatively moderate temperatures and pressures, with the resulting solid having the outward characteristics of ice, being either white or grey in colour and cold to the touch. At ambient temperatures and pressures natural gas hydrates break down releasing natural gas.

Conventionally, gas storage is achieved through re-injecting into reservoirs, or pressurised reservoirs or through the use of line pack, where the volume of the pipeline system is of the same order of magnitude as several days' customer consumption. The use of natural gas hydrates in storage has the potential to provide a flexible way of storing reserves of natural gas to meet short to medium term requirements in the event of excessive demands or a reduction in the delivery of gas from source.

In any application, the gas content of the hydrate and the temperature at which the hydrate begins to decompose (i.e. the hydrate desolution temperature), are significant criteria that require consideration. Known natural gas hydrates exhibit a gas content of 163 $Sm^3$ per $m^3$ of hydrate, and a hydrate desolution temperature, at atmospheric pressure, of −15° C.

It is one object of the present invention to provide a natural gas hydrate and a method for the production thereof, with improved gas content and hydrate desolution temperature.

Throughout the specification, unless the context requires otherwise, the word "comprise" or variations such as "comprises" or "comprising", will be understood to imply the inclusion of a stated integer or group of integers but not the exclusion of any other integer or group of integers.

DISCLOSURE OF THE INVENTION

In accordance with the present invention there is provided a natural gas hydrate with a gas content in excess of 163 $Sm^3$ per $m^3$. Preferably, the natural gas hydrate has a gas content in excess of 170 $Sm^3$ per $m^3$. Preferably still, the natural gas hydrate has a gas content in excess of 180 $Sm^3$ per $m^3$. Further and still preferably, the natural gas hydrate has a gas content of 186 $Sm^3$ per $m^3$. In a highly preferred form of the invention, the natural gas hydrate has a gas content in excess of 220 $Sm^3$ per $m^3$. Preferably still, the natural gas hydrate has a gas content in excess of approximately 227 $Sm^3$ per $m^3$.

Preferably, the natural gas hydrate exhibits a hydrate desolution temperature in excess of −15° C. at atmospheric pressure. Preferably still, the natural gas hydrate exhibits a hydrate desolution temperature in excess of −13° C. at atmospheric pressure. Further and still preferably, the natural gas hydrate exhibits a hydrate desolution temperature in excess of −11° C. at atmospheric pressure. In a highly preferred form of the invention, the natural gas hydrate exhibits a hydrate desolution temperature in excess of −5° C. at atmospheric pressure. Preferably still, the natural gas hydrate exhibits a hydrate desolution temperature in excess of 3° C. at atmospheric pressure.

In accordance with the present invention, there is further provided a natural gas hydrate which exhibits a hydrate desolution temperature in excess of −15° C. at atmospheric pressure. Preferably, the natural gas hydrate exhibits a hydrate desolution temperature in excess of −13° C. at atmospheric pressure. Preferably still, the natural gas hydrate exhibits a hydrate desolution temperature in excess of −11° C. at atmospheric pressure. Further and still preferably, the natural gas hydrate exhibits a hydrate desolution temperature in excess of −5° C. at atmospheric pressure. In a highly preferred form of the invention, the natural gas hydrate exhibits a hydrate desolution temperature in excess of 3° C. at atmospheric pressure.

Preferably, the natural gas hydrate has a gas content in excess of 163 $Sm^3$ per $m^3$. Preferably still, the natural gas hydrate has a gas content in excess of 170 $Sm^3$ per $m^3$. Further and still preferably, the natural gas hydrate has a gas content in excess of 180 $Sm^3$ per m3. In a highly preferred form of the invention, the natural gas hydrate has a gas content of 186 $Sm^3$ per $m^3$. In one form of the invention, the natural gas hydrate has a gas content in excess of 220 $Sm^3$ per $m^3$. Preferably still, the natural gas hydrate has a gas content in excess of approximately 227 $Sm^3$ per $m^3$.

In accordance with the present invention there is still further provided a method for the production of the natural gas hydrate of the present invention, the method comprising the steps of:

- combining natural gas and water to form a natural-gas water system and an agent adapted to reduce the natural gas-water interfacial tension to form a natural-gas water-agent system;
- allowing the natural gas-water-agent system to reach equilibrium at elevated pressure and ambient temperature; and
- reducing the temperature of the natural gas-water-agent system to initiate the formation of the natural gas hydrate.

Preferably, the method of the present invention comprises the additional step of, before combining the natural gas and water, atomising the natural gas and water.

Preferably, the natural gas-water-agent system is agitated before the temperature is reduced.

Preferably, the agent is a compound that is at least partially soluble in water.

In one form of the invention, the agent is an alkali metal alkylsulfonate. Preferably, where the agent is an alkali metal alkylsulfonate, the alkali metal alkylsulfonate is a sodium alkylsulfonate. Where the agent is a sodium alkylsulfonate, the agent may be selected from the group; sodium lauryl sulfate, sodium 1-propanesulfonate, sodium 1-butane sulfonate, sodium 1-pentanesulfonate, sodium 1-hexane sulfonate sodium 1-heptane sulfonate, sodium 1-octanesulfonate, sodium 1-nonanesulfonate, sodium 1-decanesulfonate, sodium 1-undecanesuffonate, sodium 1-dodecanesulfonate and sodium 1-tridecane sulfonate.

Where the agent is an alkali metal sulfonate, the amount of agent added is preferably such that the concentration of the agent in the natural gas-water-agent system is less than about 1% by weight. Preferably still, the amount of agent added results in a concentration of the agent less than about 0.5% by weight. Further and still preferably, the amount of agent added results in a concentration of the agent between about 0.1 and 0.2% by weight.

In an alternate form of the invention, the agent is sodium lauryl sulfate. Where the agent is sodium lauryl sulfate, the amount of agent added is preferably such that the concentration of the agent in the natural gas-water-agent system is less than about 1% by weight. Preferably still, the amount of agent added results in a concentration of the agent less than about 0.5% by weight. Further and still preferably, the amount of agent added results in a concentration of the agent between about 0.1 and 0.2% by weight.

In an alternate form of the invention, the agent is sodium tripolyphoshate. Where the agent is sodium tripolyphosphate, the amount of agent added is preferably such that the concentration of the agent in the natural gas-water-agent system is between about 1 and 3% by weight.

In an alternate form of the invention, the agent is an alcohol. Preferably, where the agent is an alcohol, the agent is isopropyl alcohol. Where the agent is isopropyl alcohol, the amount of agent added is preferably such that the concentration of the agent in the natural gas-water-agent system is about 0.1% by volume.

The degree to which the temperature is decreased depends upon the degree to which the pressure is elevated. However, preferably the pressure exceeds about 50 bars and preferably, the temperature is below about 18° C.

Preferably, the natural-gas-water-agent system is constantly mixed throughout the hydration process.

EXAMPLES

The present invention will now be described in relation to five examples. However, it must be appreciated that the following description of those examples is not to limit the generality of the above description of the invention.

Hydrate Formation

Example 1

Isopropyl Alcohol

Water and isopropyl alcohol (0.1% by volume) were introduced into a sapphire cell. The cell was pressurised with methane gas above the hydrate equilibrium pressure for a normal water-methane system. Equilibrium was achieved quickly by bubbling the methane through the water phase. The system was stabilised at a pressure of 206 bars (3000 psia) and room temperature of 23° C.

The temperature was then reduced at a rate of 0.1° C. per minute using a thermostat air bath to 17.7° C. Crystals of methane hydrate were observed on the sapphire window, and hydrate formation was assumed to be complete when pressure had stabilised in the cell.

Example 2

Isopropyl Alcohol

Water and isopropyl alcohol (0.1% by volume) were introduced into a sapphire cell. The cell was pressurised with methane gas above the hydrate equilibrium pressure for a normal water-methane system. Equilibrium was achieved quickly by bubbling the methane through the water phase. The system was stabilised at a pressure of 138 bars (2000 psia) and room temperature of 23° C.

The temperature was then reduced at a rate of 0.1° C. per minute using a thermostat air bath to 15.5° C. Crystals of methane hydrate were observed on the sapphire window, and hydrate formation was assumed to be complete when pressure had stabilised in the cell.

Example 3

Isopropyl Alcohol

Water and isopropyl alcohol (0.1% by volume) were introduced into a sapphire cell. The cell was pressurised with methane gas above the hydrate equilibrium pressure for a normal water-methane system. Equilibrium was achieved quickly by bubbling the methane through the water phase. The system was stabilised at a pressure of 102 bars and room temperature of 23° C.

The temperature was then reduced at a rate of 0.1° C. per minute using a thermostat air bath to 13.1° C. Crystals of methane hydrate were observed on the sapphire window, and hydrate formation was assumed to be complete when pressure had stabilised in the cell.

Example 4

Isopropyl Alcohol

Water and isopropyl alcohol (0.1% by volume) were introduced into a sapphire cell. The cell was pressurised with methane gas above the hydrate equilibrium pressure for a normal water-methane system. Equilibrium was achieved quickly by bubbling the methane through the water phase. The system was stabilised at a pressure of 54.5 bars (800 psia) and room temperature of 23° C.

The temperature was then reduced at a rate of 0.1° C. per minute using a thermostat air bath to 8.1° C. Crystals of methane hydrate were observed on the sapphire window, and hydrate formation was assumed to be complete when pressure had stabilised in the cell.

Example 5

Sodium Tripolyphosphate

Water and sodium tripolyphosphate (1% by weight) and methane gas were introduced into a sapphire cell. The pressure was adjusted to 1400 psia, and the mixture cooled rapidly to −5° C., where formation of the hydrate was observed. The methane bubbling through the gas served to agitate the system.

Example 6

Sodium Lauryl Sulfate

Water and sodium lauryl sulfate (0.11% by weight) and methane gas were introduced into a sapphire cell. The mixture was pressurised to 2200 psia at 30° C., and left to equilibrate for 45 minutes. The mixture was then flashed into a cryogenic PVT cell at −3° C., causing the fluid to atomise and resulting in the formation of hydrate.

Example 7 sodium 1-octanesulfonate

Water and sodium-octanesulfonate (0.15% by weight) and methane gas were introduced into a sapphire cell. The mixture was pressurised to 2200 psia at 30° C., and left to equilibrate for 45 minutes. The mixture was then flashed into a cryogenic PVT cell at −3° C., causing the fluid to atomise and resulting in the formation of hydrate.

Example 8 sodium 1-octanesulfonate

Water and sodium 1-octanesulfonate (0.1% by weight) and methane gas were introduced into a sapphire cell. The mixture was pressurised to 2200 psia at 30° C., and left to equilibrate for 45 minutes. The mixture was then flashed into a cryogenic PVT cell at −3° C., causing the fluid to atomise and resulting in the formation of hydrate.

Testing Desolution Temperature and Natural Gas Content of Hydrate

Example 1

Having formed the hydrate as outlined in Example 1, excess methane was removed and the temperature of the system was reduced to −15° C., at a rate of 0.1° C. per minute, and the pressure of the system was observed to diminish to zero.

The hydrate was stored for more than 12 hours at −15° C., showing no observable changes in appearance. The pressure remained at zero throughout.

After 12 hours, the temperature of the system was gradually increased at a rate of 0.2° C. per minute, in an attempt to reverse the hydrate formation process. Throughout this stage the pressure of the system was carefully monitored and recorded by way of high precision digital pressure gauges. The pressure of the system remained stable until the temperature reached −11.5° C., at which point some increase was noted. The pressure continued to increase as the temperature increased until the pressure of the system stabilised at 206.3 bars at the ambient temperature of 23° C.

Quantities of methane and water generated from the desolution of the hydrate were measured, and the methane content of the methane hydrate was calculated to be 186 $Sm^3$ per $m^3$.

Example 5

Having formed the hydrate as outlined in Example 5, the system was heated carefully. The hydrate was observed to melt at approximately 2° C. Based on the pressure-volume relationship, and excess methane before and after hydrate formation, the amount of methane contained in the hydrate was estimated to be in excess of 230 $Sm^3$ per $m^3$ of hydrate.

Examples 6 to 8

Having formed the hydrates as outlined in Examples 6 to 8, the systems were heated carefully. Each of the hydrates was observed to melt at approximately 3° C. Based on the pressure-volume relationship, and excess methane before and after hydrate formation, the amount of methane contained in the hydrate produced in Example 6 was estimated to be in excess of 227 $Sm^3$ per $m^3$ of hydrate. Similarly, the amount of methane contained in the hydrate produced in Example 7 was estimated to be in excess of 212 $Sm^3$ per $m^3$ of hydrate. The amount of methane contained in the hydrate produced in Example 8 was estimated to be in excess of 209 $Sm^3$ per $m^3$ of hydrate.

Each unique mixture of hydrocarbon and water has its own hydrate formation curve, describing the temperatures and pressures at which the hydrate will form, and it is envisaged that additional analysis will reveal optimum pressure and temperature combinations, having regard to minimising the energy requirements for compression and cooling.

What is claimed is:

1. A method for the production of a natural gas hydrate characterised by the steps of:

pre-mixing natural gas and water and an agent adapted to reduce the natural gas-water interfacial tension to form a natural-gas water-agent system;

allowing the natural gas-water-agent system to reach equilibrium at elevated pressure and ambient temperature; and, after the natural gas-water-agent system has reached equilibrium at elevated pressure and ambient temperature, reducing the temperature of the natural gas-water-agent system to initiate the formation of the natural gas hydrate.

2. A method according to claim 1 characterised by the additional step of, before pre-mixing natural gas and water and the agent adapted to reduce interfacial tension, atomising the natural gas and water.

3. A method according to claim 1 characterised by the natural gas-water-agent system being agitated before the temperature is reduced.

4. A method according to claim 1 characterised in that the agent is a compound that is at least partially soluble in water.

5. A method according to claim 4 characterised in that the agent is an alkali metal alkylsulfonate.

6. A method according to claim 4 characterised in that the agent is a sodium alkylsulfonate.

7. A method according to claim 4 characterised in that the agent is selected from the group consisting of sodium lauryl sulfate, sodium 1-propanesulfonate, sodium 1-butane sulfonate, sodium 1-pentanesulfonate, sodium 1-hexane sulfonate, sodium 1-heptane sulfonate, sodium 1-octanesulfonate, sodium 1-nonanesulfonate, sodium 1-decanesulfonate, sodium 1-undecanesulfonate, sodium 1-dodecanesulfonate and sodium 1-tridecane sulfonate.

8. A method according to claim 4 characterised in that the amount of agent added is such that the concentration of the agent in the natural gas-water-agent system is less than about 1% by weight.

9. A method according to claim 4 characterised in that the amount of agent added results in a concentration of the agent less than about 0.5% by weight.

10. A method according to claim 4 characterised in that the amount of agent added results in a concentration of the agent between about 0.1 and 0.2% by weight.

11. A method according to claim 4 characterised in that the agent is sodium lauryl sulfate.

12. A method according to claim 4 characterised in that the agent is sodium lauryl sulfate and the amount of agent added is preferably such that the concentration of the agent in the natural gas-water-agent system is less than about 1% by weight.

13. A method according to claim 4 characterised in that the agent is sodium lauryl sulfate and the amount of agent added results in a concentration of the agent less than about 0.5% by weight.

14. A method according to claim 4 characterised in that the agent is sodium lauryl sulfate and the amount of agent added results in a concentration of the agent between about 0.1 and 0.2% by weight.

15. A method according to claim 4 characterised in that the agent is sodium tripolyphosphate.

16. A method according to claim 4 characterised in that the agent is sodium tripolyphosphate and the amount of agent added is preferably such that the concentration of the agent in the natural gas-water-agent system is between about 1 and 3% by weight.

17. A method according to claim 4 characterised in that the agent is an alcohol.

18. A method according to claim 4 characterised in that the agent is isopropyl alcohol.

19. A method according to claim 4 characterised in that the agent is isopropyl alcohol and the amount of agent added is preferably such that the concentration of the agent in the natural gas-water-agent system is about 0.1% by volume.

20. A method according to claim 1 characterised in that the pressure exceeds about 50 bars.

21. A method according to claim 1 characterised in that the temperature is below about 18° C.

22. A method according to claim 1 wherein the natural gas-mixed water-agent system is constantly mixed throughout the method.

* * * * *